United States Patent [19]

Baker

[11] Patent Number: 4,683,982

[45] Date of Patent: Aug. 4, 1987

[54] LADDER LEVELER APPARATUS

[75] Inventor: Gerald G. Baker, Missoula, Mont.

[73] Assignee: Chester M. Murphy, Missoula, Mont. ; a part interest

[21] Appl. No.: 915,703

[22] Filed: Oct. 6, 1986

[51] Int. Cl.[4] ..... E06C 7/44

[52] U.S. Cl. ..... 182/204; 182/111

[58] Field of Search ..... 182/205, 204, 203, 201, 182/108, 111

[56] References Cited

U.S. PATENT DOCUMENTS

| | | | |
|---|---|---|---|
| 1,751,173 | 3/1930 | Rice | 182/205 |
| 2,485,413 | 10/1949 | Ross | 182/201 |
| 3,394,774 | 7/1968 | Lanier | 182/204 |
| 4,236,603 | 12/1980 | Talley | 182/204 |
| 4,423,797 | 1/1984 | Batten | 182/204 |

FOREIGN PATENT DOCUMENTS

| | | | |
|---|---|---|---|
| 112531 | 2/1941 | Australia | 182/204 |

*Primary Examiner*—Reinaldo P. Machado
*Attorney, Agent, or Firm*—Arthur L. Urban

[57] ABSTRACT

Ladder leveler apparatus includes a frame portion, a support portion, an affixing portion, an aligning portion and a positioning portion. The frame portion includes an elongated U-shaped section, the U-shaped section including a main section having a width slightly larger than the width of a ladder leg. Transverse side sections extend from the main section adjacent side edges thereof along substantially the entire length of the main section, the side sections having a width at least about equal to the thickness of the ladder leg. The main section includes at least one longitudinal channel section. The support portion includes a foot member extending from one end of the frame portion, the foot member being pivotally connected to the ladder leg. The foot member includes a connector section and a base section disposed on a free end of the connector section remote from the ladder leg. The affixing portion includes at least one bolt member extending through the longitudinal channel section of the main section and through a transverse opening in the ladder leg. An adjustable fastener is disposed on the free end of the bolt member to selectively secure the main section to the ladder leg. The aligning portion includes mechanism securable to the frame portion disposed closely adjacent to the periphery of the ladder leg remote from the main section. The positioning portion includes a transverse pin member extending through aligned openings in the side sections.

14 Claims, 6 Drawing Figures

LADDER LEVELER APPARATUS

This invention relates to a novel apparatus for use with a ladder and more partacularly relates to a new apparatus for leveling a ladder.

Ladders have been used throughout history. Originally, ladders were made by tying spaced cross pieces between two long poles. The spacing and parallelism of the cross pieces or rungs depended upon the eye and skill of the workman. As civiliation developed, ladders were manufactured in shops and factories. Jigs and templates were employed to insure the accurate and uniform placement of the rungs. Ladders originally were constructed of wood, but more recently aluminum ladders have become popular.

Ladders today are of two general types, step ladders and extension ladders. Step ladders which ordinarily fold have an A-shaped configuration with one side having a series of steps. Extension ladders have two straight sections that are mounted in parallel adjacent planes in an overlapping relationship. The sections can be compressed for carrying and storage and extended to a desired length for use. Although the two sections usually are used together to provide a greater overall length than either section, they can be separated and used individually if desired.

While step ladders are self supporting, extension ladders have to be placed against a vertical surface such as a wall of a building. The upper end of the ladder is placed in contact with the building and the bottom end or legs of the ladder rest on the ground a distance out from the building.

Extension ladders enable a person to reach a long distance above the ground with a structure that is relatively compact, but such ladders do have certain shortcomings. They are difficult to handle and position when extended. Also, they have a very small horizontal dimension compared with their extended length. This makes them very unstable, and as a result, many injuries are incurred each year due to persons falling from extension ladders.

Some falls are the result of persons reaching too far to the side of the ladder so the center of gravity shifts away from the ladder causing it to tip over. While tipping can occur when a ladder is placed on a firm level base, the chance of tipping is much greater when the ladder legs are placed on a base that slopes to the left or right. Since a ladder is very long as compared with its width, any variation in the base surface on which the ladder rests is magnified in the inclination of the ladder to the left or right of its base.

To maintain a ladder vertical under such conditions, a workman ordinarily will place an object under the bottom of the legs. Usually, a rock or wooden board is placed under the leg. While this may level the ladder at that particular position, moving the ladder to another location, e.g. along a wall, may change the inclination of the base surface requiring that a number of objects of different thicknesses be available to provide the needed leveling. This can make the leveling time-consuming and frustrating as well as of questionable safety.

In situations in which the slope is quite pronounced or involves a step, the use of thin spacers will not be sufficient. Using thicker spacers may present the additional problem of keeping the spacer in place and not shifting down the slope. Any movement of the spacer can be disastrous and result in serious injury.

To overcome these problems, a number of ladder leveling devices have been proposed and patented. Examples of such include U.S. Pat. Nos. 432,263; 809,057; 1,013,515; 1,179,391; 1,705,000; 2,115,395; 2,360,640; 2,599,117; 3,414,082 and Des. 230,370. None of these devices has gained acceptance over the years. Some are difficult to adjust. Others are not rigid enough for safe use. Some are too expensive and still others are not adaptable to different ladders.

Althugh injuries have been sustained through the years and were tolerated, in recent years the very high cost of liability both in claims and insurance as well as medical expenses have created a crisis both for ladder manufacturers and also for users.

From the above discussion, it is clear that previous methods and devices for leveling ladders have not proved satisfactory for many users. Thus, there is a need for a new ladder leveling apparatus that overcomes the shortcomings of earlier designs.

The present invention provides a novel ladder leveler apparatus which not only overcomes the deficiencies of earlier devices but also has features and advantages not found in such devices. The ladder leveler apparatus of the present invention provides a high degree of safety for the user. Also, the ladder leveler apparatus can be adjusted easily and quickly to conform with different base surfaces.

The ladder leveler apparatus of the present invention is simple in design and can be produced relatively inexpensively. Commercially available materials and components can be used in the fabrication thereof. Conventional manufacturing techniques and procedures can be utilized by semi-skilled labor in the production of the apparatus.

The ladder leveler apparatus of the invention is durable in construction and has a long useful life. Little, if any, maintenance is required to keep the apparatus in good working condition.

The apparatus can be mounted on a ladder leg easily and quickly without special skills or tools. Only a minimum of instruction is required to mount and use the apparatus efficiently.

The ladder leveler apparatus can be mounted on a variety of ladders conveniently. The apparatus is adjustable to accommodate wide variations in base surfaces.

These and other benefits and advantages of the novel ladder leveler apparatus of the present invention will be apparent from the following description and the accompanying drawings in which.

Figure 1:
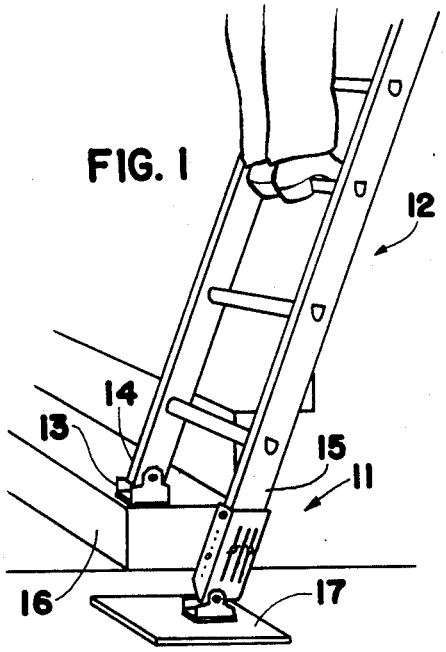
FIG. 1 is a view in perspective of one form of ladder leveler apparatus of the invention in use with a ladder.
Figure 2:
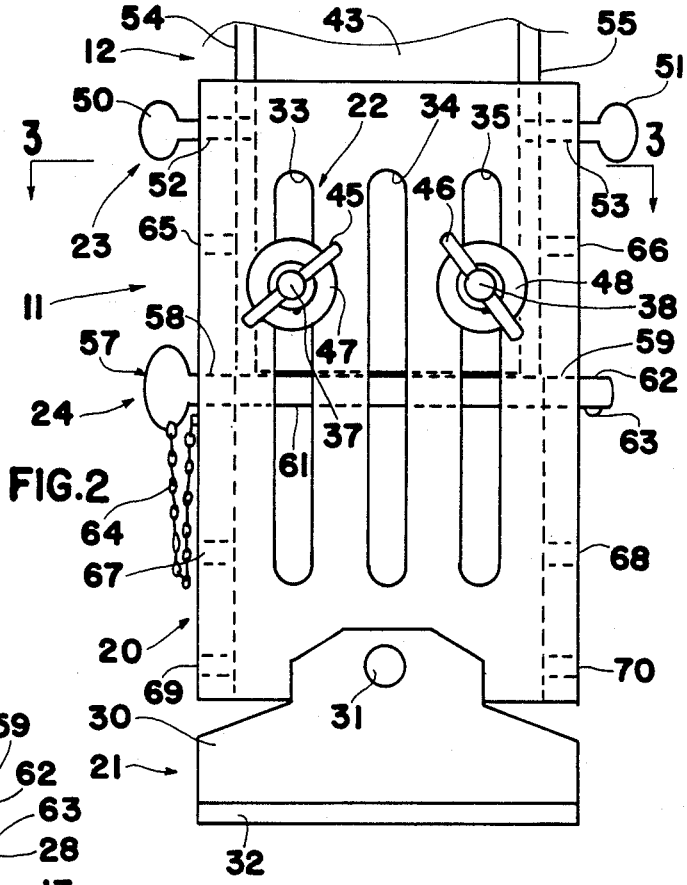
FIG. 2 is an enlarged front view of the ladder leveler apparatus shown in FIG. 1.
Figure 3:
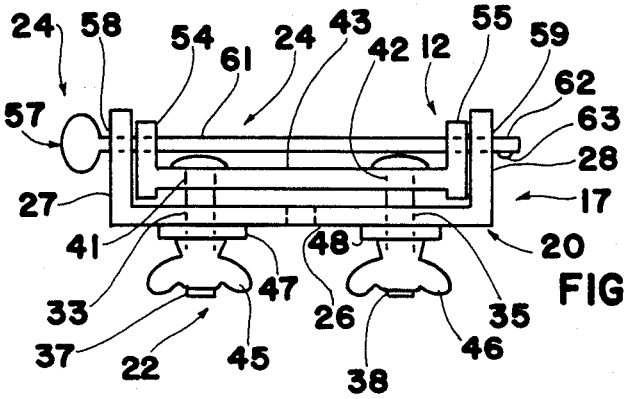
FIG. 3 is a sectional view of the ladder leveler apparatus shown in FIG. 2 taken along line 3—3 thereof.

As shown in FIGS. 1–3 of the drawings, one form of ladder leveler apparatus 11 of the present invention is mounted on a ladder 12. The ladder 12 includes legs 14 and 15. The bottom of ladder leg 14 includes a conventional foot 13 which rests on a step 16. The other ladder leg 15 which is too short to contact a patio stone 17 located at a lower level than the step, includes the ladder leveler apparatus 11 to extend the length of the leg so the ladder 12 will be stable and can be climbed safely.

The ladder leveler apparatus 11 of the invention includes a frame portion 20, a support portion 21, an affixing portion 22, an aligning portion 23 and a positioning portion 24.

The frame portion 20 of the ladder leveler apparatus 11 includes an elongated U-shaped section 25. The U-shaped section 25 includes a main section 26 that has a width slightly larger than the width of ladder leg 15.

Transverse sections 27 and 28 extend from the main section adjacent side edges thereof. The side sections 27 and 28 extend along substantially the entire length of the main section. The side sections have a width at least about equal to the thickness of the ladder leg.

The main section 26 and the side sections 27 and 28 advantageously are formed as a unitary structure. The frame portion 20 preferably has a length at least twice the width thereof. The transverse side sections 27 and 28 advantageously include a plurality of aligned openings 65–70 along the lengths thereof.

The main section 26 includes at least one longitudinal channel section 33 and advantageously a plurality of channels shown in the drawings as channels 33, 34 and 35. Preferably, the channel or channels extend along a major part of the length of the frame portion.

The support portion 21 of the ladder leveler apparatus 11 of the present invention includes a foot member 30. The foot member extends from one end (the lower end) of the frame portion 20. The foot member is pivotally joined to the ladder leg 15 through a connector section 31.

The foot member 30 also includes a base section 32. The base section 32 is disposed on a free end of the connector section that is remote from the ladder leg. The base section preferably includes gripping means 32*a*.

The affixing portion 22 of the ladder leveler apparatus 11 includes at least one bolt member 37 and advantageously a plurality of bolt members shown as bolts 37 and 38. The bolts extend through the longitudinal channel sections 33 and 35 of the main section 26 and through transverse openings 41 and 42 in the ladder main section 43.

Adjustable fastening means shown as wing nuts 47 and 48 are disposed on the free ends of the bolts 37 and 38. Preferably, washers 47 and 48 are employed with the wing nuts.

The aligning portion 23 of the ladder leveler apparatus 11 of the invention includes means securable to the frame portion 20. The aligning portion 23 is disposed closely adjacent to the periphery of the ladder leg remote from the main section 26. As shown in FIG. 2, the aligning portion includes screw members 50 and 51. The screw members 50 and 51 are threaded through openings 52 and 53 in the frame side sections 27 and 28 respectively. The screw members are advanced into contact with the side edges 54 and 55 of the ladder leg 15.

The positioning portion 24 of the ladder leveler apparatus 11 of the invention includes a transverse pin member 57. The pin member 57 extends through aligned openings 58 and 59 in the side sections 27 and 28 of the frame portion 20. Advantageously, the pin member 57 includes retaining means shown as depressable ball 63 adjacent the free end 62 of the pin member to hold the pin between the side frame sections.

The pin member 57 also includes elongated flexible means shown as chain 64. The chain 64 connects the head end of the pin member with the frame portion 20 to prevent loss thereof when not disposed between the side sections.

Figure 4:
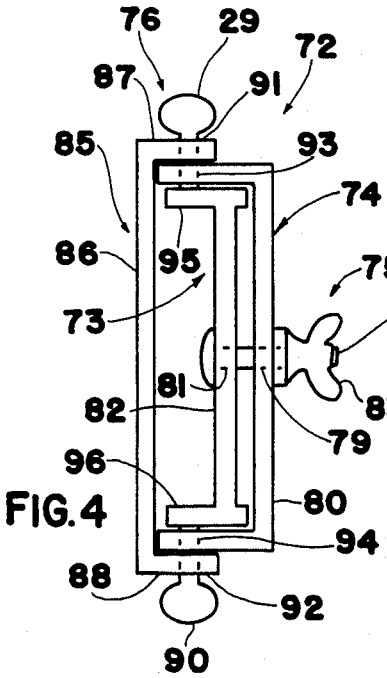
FIG. 4 is a sectional view of another form of ladder leveler apparatus of the invention.
Figure 5:
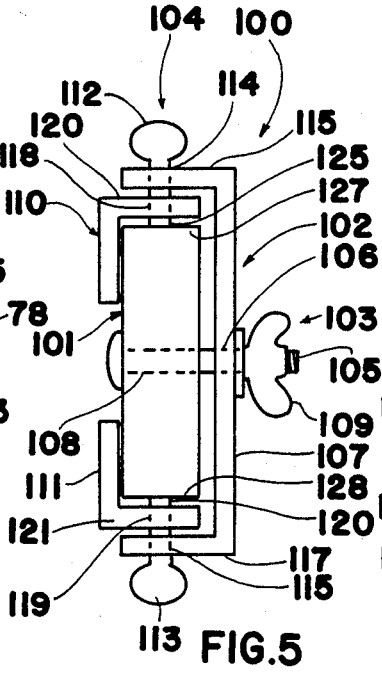
FIG. 5 is a sectional view of a further form of ladder leveler apparatus of the invention.
Figure 6:
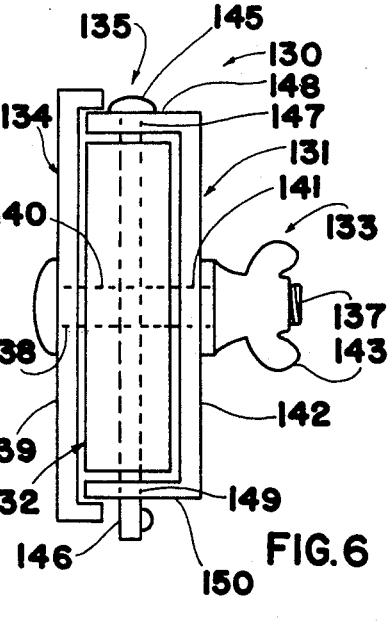
FIG. 6 is a sectional view of still another form of ladder leveler apparatus of the invention.

FIGS. 4, 5 and 6 of the drawings illustrate other forms of the ladder leveler apparatus of the present invention. As shown in FIG. 4, a leveler apparatus 72 affixed to a ladder 73 includes a frame portion 74, an affixing portion 75 and an aligning portion 76 in addition to support and positioning portions (not shown).

The affixing portion 75 includes a bolt member 78 that extends through channel section 79 in the main section 80 of the frame portion 74. The bolt 78 also extends through an opening 81 in the main section 82 of the ladder 73. The ladder is secured to the main section through wing nut 83 which is tightened on the end of the bolt 78.

Aligning portion 76 of the leveler apparatus 72 of the invention includes a plate member 85 with a central section 86 and right angle flange sections 87 and 88. Screw members 89 and 90 are threaded through openings 91 and 92 in the flange sections 87 and 88 respectively. The screw members 89 and 90 also extend through openings 93 and 94 in side sections of the frame portion 74 and bear against side sections 95 and 96 of the ladder leg 73.

In FIG. 5 is shown a ladder leveler apparatus 100 mounted on a wooden ladder 101 which includes a frame portion 102, an affixing portion 103 and an aligning portion 104, together with a support portion and a positioning portion (not shown). The affixing portion 103 includes a bolt member 105 that extends through channel 106 in main section 107 of the frame portion 102. The bolt further extends through a passage 108 in ladder 101. The ladder and the frame portion are secured together by a wing nut 109 threaded onto the end of the bolt 105.

The aligning portion 104 of the ladder leveler apparatus of the invention includes a pair of spaced right angle sections 110 and 111. The right angle sections contact the corner edges of the ladder remote from the main section of the frame portion.

The right angle sections 110 and 111 are secured to the ladder through screw members 112 and 113 that are threaded through openings 114 and 115 in side sections 116 and 117 of the frame portion. The screw members further extend through openings 118 and 119 in sections 120 and 121 of the right angle sections. The ends 125 and 126 of the screws bear against side edges 127 and 128 of the ladder leg 101.

FIG. 6 illustrates a ladder leveler apparatus 130 mounted on a wooden ladder 132. The apparatus includes a frame portion 131, an affixing portion 133, an aligning portion 134 and a positioning portion 135.

The affixing portion includes a bolt member 137 that extends through channel 141 in main section 142 of frame portion 131. The bolt also extends through an opening 138 in plate section 139 of aligning portion 134 and passage 140 in ladder 132. Tightening wing nut 143 on bolt 137 draws the ladder into contact with main section 142.

Positioning portion 135 includes a pin member 145 with a free end 146. The pin extends through opening 147 in side section 148 of the frame portion and out opening 149 of the other side section 150. The bottom of the ladder rests on the pin member.

The ladder leveler apparatus of the invention may be fabricated from a variety of materials including metals, structural plastics, combinations thereof and the like. The materials of particular components are selected to provide high structural strength and rigidity at lowest cost.

The the use of the ladder leveler apparatus 11 of the present invention, the apparatus first is mounted on ladder leg 15. This is accomplished by positioning the frame portion 20 over the ladder leg with the main section 26 against a major surface of the ladder leg and the side sections 27 and 28 along the side sections 54 and 55 of the ladder. Next, a number of openings 41 and 42 are drilled through the ladder from one major face to the other. These openings are aligned with the bolt members 37 and 38.

With the nuts 45 and 46 and washers 47 and 48 removed, the bolts are threaded through the openings 41 and 42 in the ladder and through channels 33 and 35 of the frame portion 20. The nuts and washers are replaced on the ends of the bolts and threaded thereon to a loose fit. This mounts the leveler apparatus 11 on the ladder leg 15 while permitting the position of the apparatus to be adjusted with respect to the ladder leg.

The frame portion 20 then is slid along the ladder leg to a position that provides the desired extension of the leg. To fix the position of the frame portion, pin member 57 is inserted through the aligned openings 58 and 59 until it extends completely therethrough and ball 63 retains the pin therein. Then, wing nuts 47 and 48 and screws 50 and 51 all are tightened. The ladder and leveler apparatus now are ready for placement.

The ladder 12 is positioned against a vertical surface such as a wall of a building (not shown) with the bottom of ladder leg 13 in contact with the higher base surface shown as step 16 and the other leg 15 with the leveler apparatus resting on the lower base surface patio stone 17. If the ladder is not precisely perpendicular, the position of the apparatus 11 can be adjusted on the ladder leg by releasing downward pressure, loosening nuts 47 and 48 and screws 50 and 51 and pulling pin 57 from the apparatus. The position of the ladder is corrected and the pin replaced through another pair of openings such as 65 and 66 and wing nuts 47 and 48 and screws 50 and 51 retightened. This same adjustment can be made when the ladder is moved to a new location.

The ladder leveler apparatus 74, 100 and 130 shown in FIGS. 4, 5 and 6 respectively of the drawings are mounted on ladder legs and used in much the same way as described above for leveler apparatus 11. With apparatus 72, an opening 81 is drilled through the ladder and bolt 78 inserted through that opening and channel 79 of the frame portion. To fix the position of the ladder with respect to the apparatus, wing nut 83 is tightened on bolt 78 and plate member 85 is affixed to the frame portion 74 by threading screws 89 and 90 into the appropriate openings and tightening same. Changing the position of the ladder is achieved easily by loosening nuts 83 and screws 89 and 90,repositioning the ladder and pin (not shown) and tightening the nuts and screws.

The apparatus 100 in FIG. 5 is mounted and adjusted in the same way as apparatus 72 with the two right angle sections being handled separately. The apparatus 130 in FIG. 6 can be mounted and adjusted through the use of a single bolt 137 and nut 143 together with pin 145.

The above description and the accompanying drawings show that the present invention provides a novel ladder leveler apparatus which not only overcomes the shortcomings of earlier methods and devices but in addition provides features and advantages not found in such devices. The ladder leveler apparatus of the invention provides a high degree of safety for the user. Also, the ladder leveler apparatus enables a user to quickly and easily adjust the ladder legs to accommodate varying base surfaces.

The ladder leveler apparatus of the invention is simple in design and can be produced relatively inexpensively from commercially available materials and components using semi-skilled labor and conventional fabricating procedures. The apparatus is durable in construction and has a long useful life with little maintenance.

The leveler apparatus can be mounted on a ladder easily and quickly without special tools or skills. The apparatus can be used efficiently after a minimum of instruction even by persons with limited mechanical aptitude or experience. The apparatus is adaptable to a wide variety of ladder designs and can be modified conveniently for special leveling situations.

It will be apparent that various modificiations can be made in the particular ladder leveler apparatus described above and shown in the drawings within the scope of the present invention. The size, configuration and arrangement of components can be different to meet specific requirements. Also, additional channels and bolts can be included if desired. These and other changes can be made in the ladder leveler apparatus provided the functioning and operation thereof are not adversely affected. Therefore, the scope of the present invention is to be limited only by the following claims.

What is claimed is:

1. Ladder leveler apparatus including a frame portion, a support portion, an affixing portion, an aligning portion and a positioning portion; said frame portion including an elongated U-shaped section, said U-shaped section including a main section having a width slightly larger than the width of a ladder leg, transverse side sections extending from said main section adjacent side edges thereof along substantially the entire length of said main section, said side sections having a width at least about equal to the thickness of said ladder leg, said main section including at least one longitudinal channel section; said support portion including a foot member extending from one end of said frame portion, said foot member being pivotally connected to said ladder leg, said foot member including a connector section and a base section disposed on a free end of said connector section remote from said ladder leg; said affixing portion including at least one bolt member extending through said longitudinal channel section of said main section and through a transverse opening in said ladder leg, adjustable fastening means disposed on the free end of said bolt member to selectively secure said main section to said ladder leg; said aligning portion including means securable to said frame portion disposed closely adjacent to the periphery of said ladder leg remote from said main section; said positioning portion including a transverse pin member extending through aligned openings in said side sections; whereby said apparatus can be connected to a ladder leg with said bolt member, said apparatus slid along said ladder leg to a desired position, said fastening means tightened on said bolt member to fix the position of said main section on said ladder leg, said pin member inserted through said side sections and said aligning means secured to said frame portion to provide a safe extension of said ladder leg.

2. Ladder leveler apparatus according to claim 1 wherein said main section and said side sections of said frame portion are formed as a unitary structure.

3. Ladder leveler apparatus according to claim 1 wherein said frame portion has a length at least twice the width thereof.

4. Ladder leveler apparatus according to claim 1 wherein said main section includes a plurality of spaced longitudinal channel sections and said affixing portion includes a plurality of bolt members therethrough.

5. Ladder leveler apparatus according to claim 1 wherein said channel section extends along a major part of the length of said frame portion.

6. Ladder leveler apparatus according to claim 1 wherein said base section of said foot member includes gripping means.

7. Ladder leveler apparatus according to claim 1 wherein said aligning portion includes screw members extending through said side sections into contact with said ladder leg.

8. Ladder leveler apparatus according to claim 1 wherein said aligning portion includes a right angle section disposed along the side of said ladder leg opposite said main section.

9. Ladder leveler apparatus according to claim 8 wherein said aligning portion is secured to said frame portion through said bolt member of said affixing portion.

10. Ladder leveler apparatus according to claim 8 wherein said aligning portion is secured to said frame portion through screw members extending through said side sections.

11. Ladder leveler apparatus according to claim 1 wherein said aligning portion includes a plate member.

12. Ladder leveler apparatus according to claim 1 wherein said aligning portion includes a pair of spaced right angle sections.

13. Ladder leveler apparatus according to claim 1 wherein said pin member includes retaining means holding the position thereof between said side frame sections.

14. Ladder leveler apparatus according to claim 1 including elongated flexible means connecting a head end of said pin member with said frame portion.

* * * * *